United States Patent [19]

Cartner

[11] Patent Number: 4,986,010

[45] Date of Patent: Jan. 22, 1991

[54] SLOPER APPARATUS

[76] Inventor: Jack O. Cartner, 1005 N. 8th St., Cambridge, Ohio 43725

[21] Appl. No.: 322,631

[22] Filed: Mar. 13, 1989

[51] Int. Cl.[5] ..... E02F 5/00

[52] U.S. Cl. ..... 37/108 R; 37/141 R; 172/753; 172/820

[58] Field of Search ..... 37/80 R, 103, 108 R, 37/118 R, 141 R, 142.5, 234, 236; 414/687, 688, 715, 722; 172/23, 26.5, 753, 820; 404/75, 96, 98, 104

[56] References Cited

U.S. PATENT DOCUMENTS

| | | | |
|---|---|---|---|
| 3,523,380 | 8/1970 | Bolyard et al. | 172/753 |
| 3,853,181 | 12/1974 | Yoshizaki | 172/820 |
| 3,927,781 | 12/1975 | Okabe | 414/715 X |
| 3,949,539 | 4/1976 | Cartner | 56/10.4 |
| 4,048,789 | 9/1977 | Cartner | 56/11.9 |
| 4,269,275 | 5/1981 | Cousin | 37/141 R X |
| 4,445,312 | 5/1984 | Cartner | 56/15.5 |
| 4,459,767 | 7/1984 | Cartner | 37/81 |
| 4,495,754 | 1/1985 | Cartner | 56/11.9 |
| 4,502,269 | 3/1985 | Cartner | 56/15.5 |
| 4,506,464 | 3/1985 | Cartner | 37/91 |
| 4,612,715 | 9/1986 | Cartner | 37/92 |

*Primary Examiner*—Dennis L. Taylor
*Assistant Examiner*—J. Russell McBee
*Attorney, Agent, or Firm*—Fay, Sharpe, Beall, Fagan, Minnich & McKee

[57] ABSTRACT

Mounted on a tractor is a sloper assembly which is adapted to push earth and debris away from a berm of a road. A support stand is pivotally connected to the tractor for rotation about a vertical axis. A first outrigger arm is pivotally connected to the support stand and extends outwardly therefrom. A first hydraulic cylinder is pivotally connected between the support stand and the first outrigger arm. A second outrigger arm is pivotally connected to the first outrigger arm and supports a sloper assembly. A second hydraulic cylinder is attached between the first outrigger arm and the second outrigger arm. A third hydraulic cylinder is operatively connected between the second outrigger arm and the sloper assembly. A fourth hydraulic cylinder, having overload protection, is operatively connected between the tractor and the support stand. Therefore, the entire support stand, first and second outrigger arms and the sloper assembly will pivot horizontally about the vertical axis when the sloper assembly meets an obstruction, to avoid damaging the tractor and the sloper assembly.

27 Claims, 6 Drawing Sheets

SLOPER APPARATUS

BACKGROUND OF THE INVENTION

The present invention pertains to earth moving equipment. More particularly, the present invention relates to the use of an articulated arm mounted on a vehicle for moving earth.

The invention finds particular application in cleaning and maintaining shoulders of roads or berms underneath and behind a guardrail and will be described with reference thereto. However, it should be appreciated that the invention also finds application in other equipment for digging, trenching or otherwise cutting or moving soil.

The buildup of debris on a berm under a guardrail and behind the guardrail is disadvantageous in that such buildup will cause water to stay on the road instead of being allowed to flow away from the road onto the shoulders of the road. This will lead to a washout of the road in heavy rains, which should be avoided if possible. While it is possible to clean the berm of a road on the road-side of a guardrail, it is difficult to clean the berm underneath and in back of the guardrail. In this regard, cleaning machinery often cannot be positioned on the berm behind the guardrail because frequently the berm slopes away from the road very quickly. Thus, one could have a 60° to 75° slope away from the road within 2 to 3 feet of the guardrail. Quite simply, the slope is too steep to allow the positioning of some sort of grading or sloping machine in that location. Whatever machine is utilized for such sloping purposes needs to be located on the road side of the guardrail.

Since the posts holding the guardrails are spaced apart by approximately 5 feet, which is the Federal Bureau of Roads standard for such post spacing, the blade of whatever cleaning equipment is utilized for cleaning underneath and behind the guardrails will need to be able to fit between each two posts to perform its cleaning function. In other words, the blades cannot be wider than 5 feet and should be preferably narrower in order that a more narrow spacing of the posts will not prevent a successful removal of debris from underneath the guardrail.

Various types of roadside maintenance equipment are known. It is known that articulated boom assemblies are particularly advantageous for supporting mowing apparatus on tractors. Such boom assemblies include a plurality of arms, a first of which is pivotally connected with a tractor and a second of which is pivotally connected between the mowing apparatus and the first arm. Hydraulic cylinders are provided to control the angular orientation of the first arm relative to the tractor and the second arm relative to the first arm. This enables the boom assembly to reach over guardrails and other structures to position the mowing apparatus. Another hydraulic cylinder can control the angular orientation of the mowing apparatus with regard to the second boom arm.

It is also known that an arm assembly extending from a tractor over any intermediate guardrails or the like can be utilized to position a ditching head along the low point of a drainage ditch in order to clean or trench the ditch.

However, at present, the only way of cleaning debris out from underneath a guardrail and moving it behind the guardrail has been through the use of a blade which is attached to the side of a tractor and is pushed out away from the tractor by a hydraulic cylinder or the like. This blade is, however, incapable of pivoting up and down as necessary in order to follow the contour of the shoulder and correctly slope the earth in back of the guardrail.

Thus, one of the problems with the conventional sloper assemblies is that the blades thereof cannot pivot enough in order to enable them to correctly slope or grade the embankment behind the guardrail. Another problem with such blades is that since they are transversely mounted to the vehicle, they can only be used directly to the side of the vehicle and do not have the capability of being moved as necessary away from a position directly normal to the longitudinal axis of the tractor.

Accordingly, it has been considered desirable to develop a new and improved sloper apparatus which would overcome the foregoing difficulties and others while providing better and more advantageous overall results.

BRIEF SUMMARY OF THE INVENTION

In accordance with the present invention, a new and improved sloper apparatus is provided which comprises a tractor and a sloper assembly adapted to push earth and debris away from a berm of a road.

More particularly in accordance with the invention, the apparatus comprises a tractor having a hydraulically powered take off, a reservoir therefor and a support stand pivotally connected to the tractor for rotation about a vertical axis. A first outrigger arm is pivotally connected to the support stand and extends outwardly therefrom and a first hydraulic cylinder is pivotally connected between the support stand and the first outrigger arm. A sloper assembly is provided along with a second outrigger arm pivotally connected to the first outrigger arm and supporting the sloper assembly. A second hydraulic cylinder extends generally parallel to the first outrigger arm, is attached thereto and is operatively connected with the second outrigger arm. A third hydraulic cylinder is operatively connected between the second outrigger arm and the sloper assembly. A fourth hydraulic cylinder is operatively connected between the tractor and the support stand. The fourth hydraulic cylinder has overload protection such that the entire support stand, first and second outrigger arms and the sloper assembly will pivot horizontally about the vertical axis in the event that the sloper assembly meets an obstruction in order to avoid damaging the tractor and the sloper assembly.

In accordance with another aspect of the invention, a mobile sloping apparatus is provided.

According to this aspect of the invention, the apparatus comprises a prime mover and an arm assembly having first and second ends. A first end of the arm assembly is operatively connected to the prime mover such that the arm assembly can undergo rotational movement about a vertical axis in relation to the prime mover. A sloper assembly is secured to the second end of the arm assembly such that the sloper assembly can undergo rotational movement about an axis parallel to a longitudinal axis of the prime mover as well as movement along a longitudinal axis lying at an angle to the prime mover longitudinal axis. The sloper assembly comprises a trunion pivotally mounted to said arm assembly second end and a sloper blade. The sloper blade has a first end at which it is secured to the trunion and a second end adapted to contact the ground surface. The sloper blade is substantially angled such that the blade second end is located at an obtuse angle in relation to the blade first end.

According to a still further aspect of the invention, a method is provided for sloping a berm of a road having a guardrail.

More particularly in accordance with this aspect of the invention, the method includes the steps of providing a sloper blade on a boom arm extending from a vehicle and positioning the arm behind a guardrail such that the sloper blade is elevated from a ground surface. A front edge of the sloper blade is then lowered to the ground surface such that the blade front edge is located substantially underneath the guardrail. The sloper blade is then moved away from the prime mover. The sloper blade edge is pivoted as necessary to keep it in contact with the ground surface even as the road shoulder recedes away from the road.

According to a further aspect of the invention, a boom grading apparatus is provided.

More particularly in accordance with this aspect of the invention, the apparatus comprises a prime mover and a sloping blade adapted for scraping a ground surface. One end of the sloping blade is secured to a trunion. A boom assembly including a first boom arm is movably interconnected to the prime mover and a second boom arm is pivotally interconnected at a first end with the first arm and at a second end with the trunion. A hydraulic actuator is mounted on the second boom arm and has a longitudinally separated extendable and contractible positions. The actuator is operatively connected at a first end with the second boom arm. A linkage assembly is pivotally secured to the trunion and the second boom arm. The linkage assembly comprises a first link having a first end pivotally coupled to the second boom arm, an elbow region pivotally coupled to a second end of the hydraulic actuator, and a second end. A second link has a first end pivotally coupled to the trunion and the second end pivotally connected to the first link second end. The linkage assembly converts a longitudinal motion of the hydraulic actuator into rotational motion of the trunion about the second boom arm.

One advantage of the present invention is the provision of a new and improved sloping or grading assembly.

Another advantage of the present invention is the provision of a sloper apparatus which includes a sloping blade that can be maneuvered underneath a guardrail and then moved away from the road surface while being pivoted in order to keep a blade edge in contact with the ground surface even as the road shoulder recedes away from the road.

Still another advantage of the present invention is the provision of a sloper assembly which can be utilized not only in a direction substantially normal to the axis of the vehicle on which it is mounted but also in many other angular orientations.

Yet another advantage of the present invention is the provision of a sloper apparatus mounted on a boom assembly in which both the boom assembly and the sloper apparatus are protected from damage by impact with relatively immovable objects.

An additional advantage of the present invention is the provision of a sloper apparatus with a hydraulic breakaway circuit that is relatively simple and easy to maintain and manufacture.

A further advantage of the present invention is the provision of a sloper apparatus in which a sloping blade is provided with a replaceable bit so that only the bit becomes worn during use and not the entire sloping blade, consequently eliminating the need for replacement of the whole sloping blade.

Still further advantages of the present invention will become apparent to others skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof and wherein.

DETAILED DESCRIPTION OF THE PREFERRED AND ALTERNATE EMBODIMENTS

Figure 1:
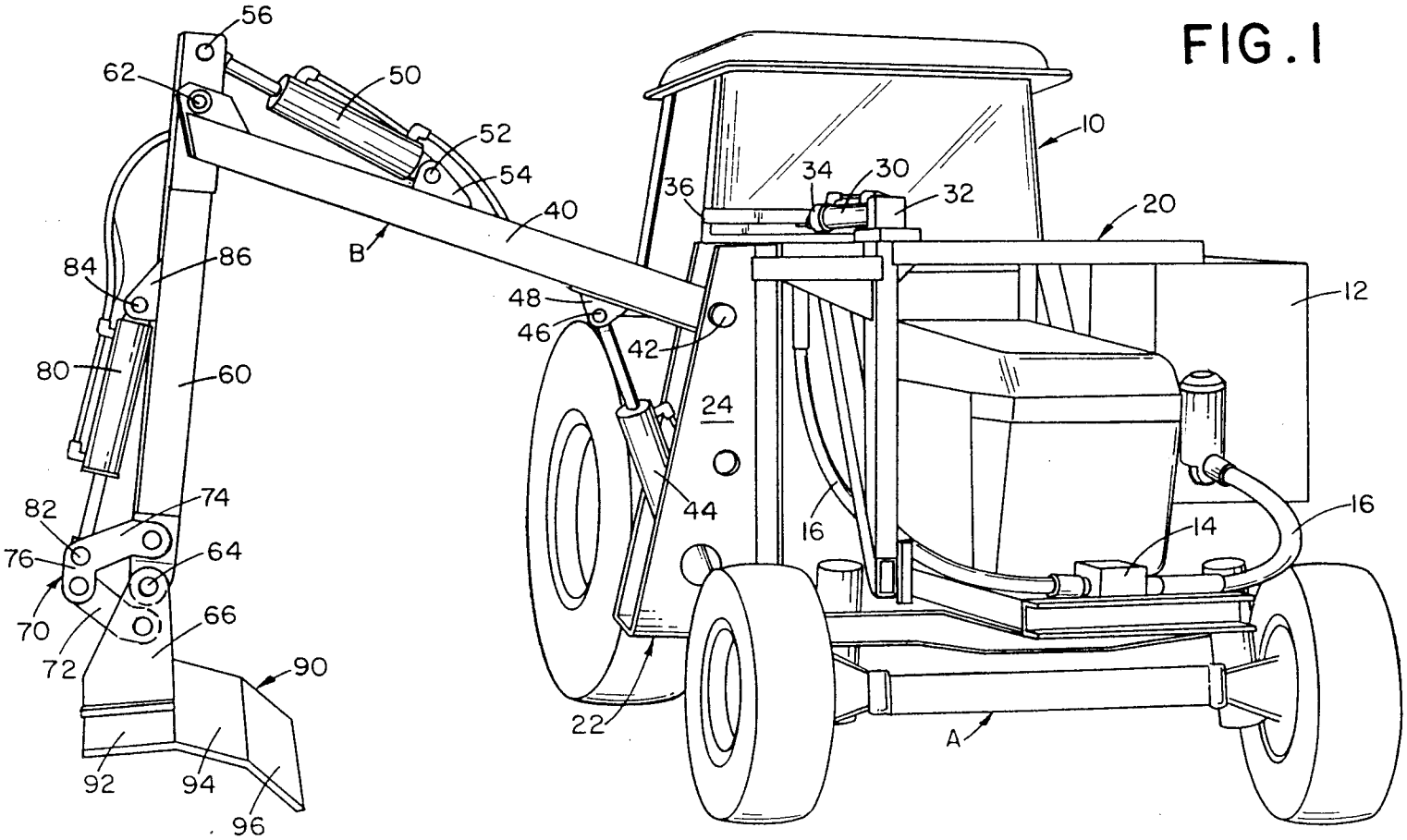
FIG. 1 is a perspective view of a sloper apparatus secured to a boom assembly attached to a tractor according to the present invention.

Referring now to the drawings, wherein the showings are for purposes of illustrating preferred and alternate embodiments of the invention only and not for purposes of limiting same, FIG. 1 shows a vehicle A having a boom assembly B to which is secured a sloper assembly according to the present invention. While the sloper assembly will be described in connection with the removal of debris from underneath and behind a guardrail on the berm of a road, it should be appreciated that the sloper assembly disclosed herein could also be adapted for use in many other environments.

More specifically, the vehicle A preferably comprises a tractor 10 having a hydraulic fluid reservoir 12 located along one side thereof and capable of delivering hydraulic power as at 14 into a plurality of hydraulic hoses 16. The arm assembly or boom assembly B comprises a saddle frame 20 that extends across the tractor and retains the assembly in place and a vertical mast 22 comprising a channel frame 24. The vertical mast 22 is mounted on the tractor 10 by the frame 20 and is capable of pivoting about a vertical axis. This permits the boom assembly to rotate fore and aft, particularly in response to impacting large rocks, posts or other stationary objects as well as to rotate to a storage position and any desired working orientation.

Figure 7:
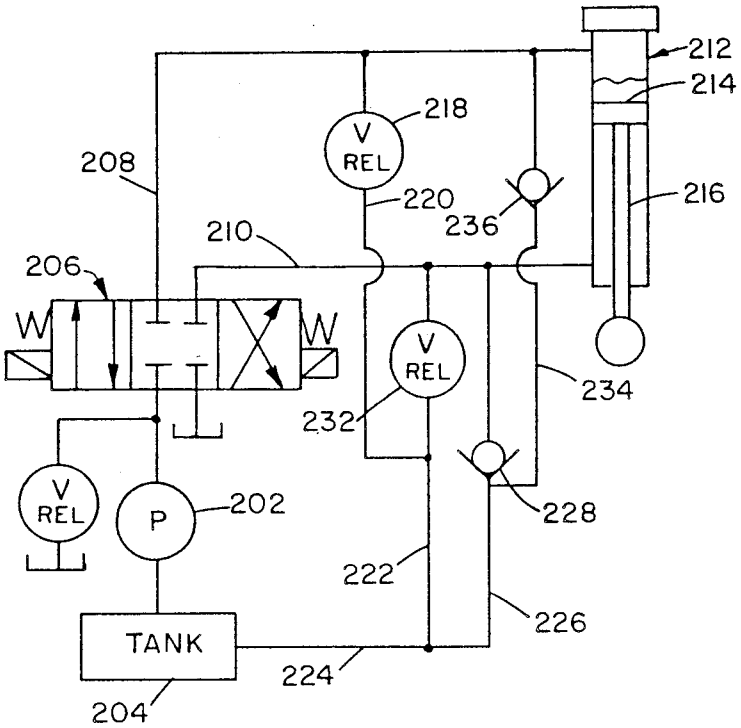
FIG. 7 is an alternate embodiment of a hydraulic breakaway system.

A swing cylinder 30 is secured at a first end 32 to the saddle frame 20 and at a second end 34 to a pivot arm 36 that is fixed to the vertical mast 22. The swing cylinder 30 can be of the conventional through rod type. As is conventional, such a the cylinder includes a piston 37 (see FIG. 4) slidably disposed therein. The piston divides the cylinder into two equal diameter chambers and a through rod 38 (see FIG. 4) is pivotally connected at one end with the pivot arm 36 and is fixably connected centrally with the piston. The other end of the through rod 38 extends through an aperture in a saddle frame flange to which the cylinder is secured. It should be recognized, however, that other types of cylinder assemblies could also be used, such as a double acting cylinder with a single end rod as shown in FIG. 7, and the cylinder shown in FIG. 8.

Also included in the arm assembly B is an inner boom arm 40 that is secured at a first end by a pivot pin 42 to the vertical mast 22. Positioned in the channel 24 of the vertical mast 22 is a hoist cylinder 44 that is pivotally secured at a first end in the channel member. A piston rod end of the hoist cylinder 44 is secured by a pin 46 to a flange or ear 48 of the inner arm 40.

Operably secured to the inner arm 40 is a crowd and retract cylinder 50. In this regard, a first end of the cylinder 50 is rotatably secured by a pin 52 between a pair of ears 54 affixed to the inner arm 40. A second end pin 56 rotatably secures a piston rod end of the crowd and retract cylinder 50 to an end of an outer boom arm 60.

Figures 2A, 2B:
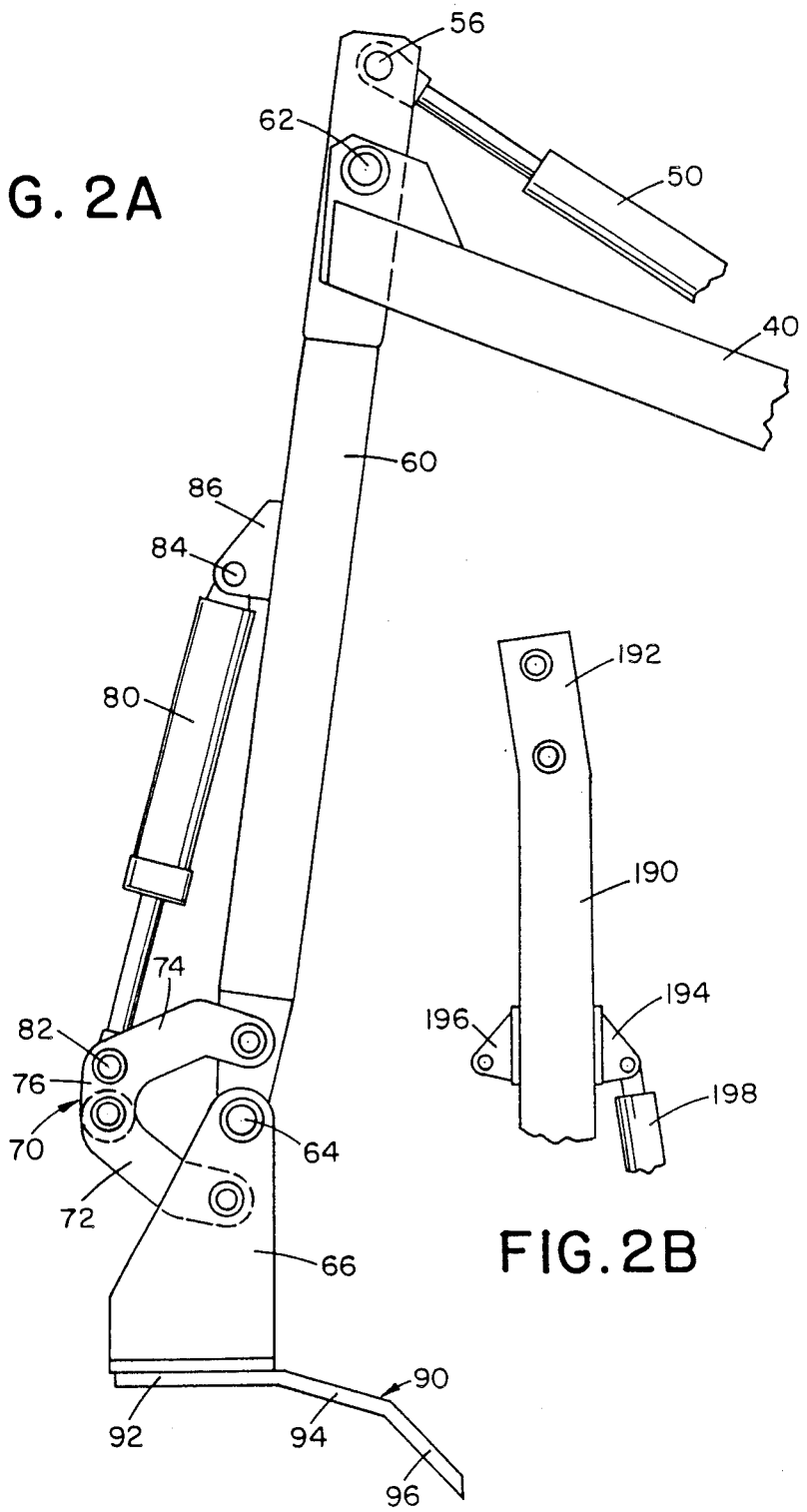
FIG. 2A is an enlarged side elevational view of an outer boom arm of the boom assembly together with the sloper apparatus.
FIG. 2B is a partially broken away view of an outer boom arm according to an alternate embodiment of the present invention.

With reference also to FIG. 2A, the outer boom arm 60 is secured by a pin 62 to the free end of the first arm 40 and by a pin 64 to a trunion 66.

A linkage assembly 70 is provided between the outer arm 60 and the trunion 66. This includes a trunion link 72 as well as an arm link 74 having an elbow section 76.

A blade cylinder 80 has a piston rod end that is rotatably secured by a pin 82 to the elbow section 76 of the arm link 74 and a second end that is rotatably secured by a pin 84 between a pair of ears 86 affixed to the outer arm 60.

Figure 5A:
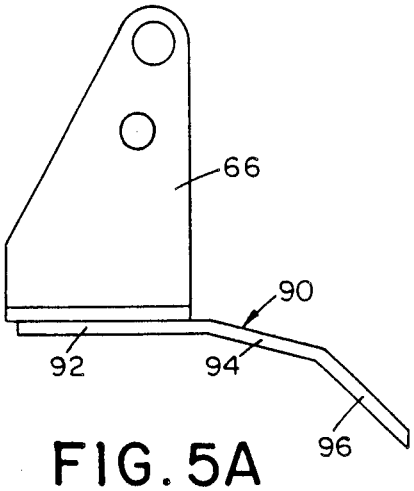
FIG. 5A is an enlarged side elevational view of a trunion and sloping blade according to a first preferred embodiment of the invention.

Fixedly secured to the trunion 66 is a blade 90. In the embodiment disclosed in FIG. 1, as well as FIG. 5A, the blade 90 comprises first, second and third planar sections 92, 94 and 96 which are angled in relation to each other. The blade can be manufactured from three planar pieces of a suitable metal that are welded to each other or from a unitary piece of metal that is suitably bent into the configuration shown in FIG. 5A.

Figure 6A:
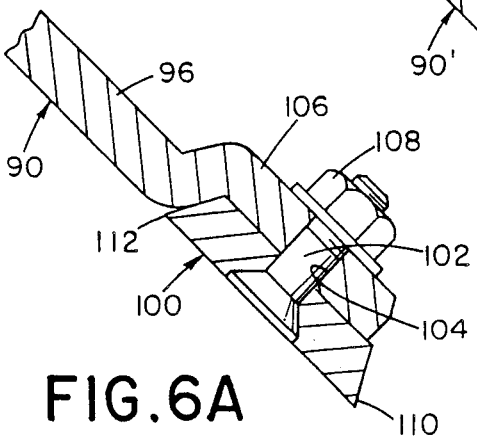
FIG. 6A is a greatly enlarged side elevational view of a free end of the sloping blade of FIG. 5A.

With reference now also to FIG. 6A, the blade 90 is preferably provided on its free edge with an edge wear bit 100 that can be suitably fastened by conventional fasteners 102 extending through apertures 104 in an indented free end 106 of the third section and selectively secured in place by nuts 108. A plurality of such fasteners are preferably employed along the length of the blade to hold an elongated wear bit in place.

Preferably, the wear bit 100 is symmetrically constructed so that it includes a pair of spaced scraping edges 110, 112. In this way, after substantial use, the bit can be removed from the blade, rotated 180°, and reattached to expose the opposite scraping edge 112 for use. It should be noted that the wear bit is preferably provided scraping edges 110, 112 that are beveled at approximately 45°-60°. The wear bit 100 can be made of a steel material or any other conventional material for this purpose.

Figure 6B:
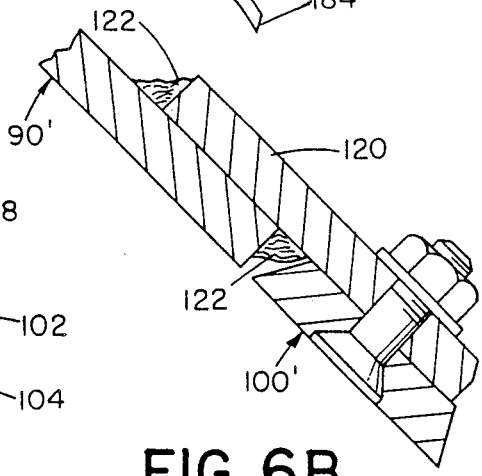
FIG. 6B is a greatly enlarged side elevational view of a free end of a sloping blade according to an alternate embodiment.

With reference now to an alternate embodiment illustrated in FIG. 6B, the edge wear bit is there shown as being secured to a different type of scraper blade free edge. For ease of illustration and appreciation of this alternative, like components are identified by like numerals with a primed (') suffix and new components are identified with new numerals.

As shown in this FIGURE, a blade 90' can be provided with a flat end to which is secured an elongated end plate 120 by suitable weld joints 122 or the like. Fastened to the end plate 120 can be a suitable edge wear bit 100' which can be identical to that disclosed in FIG. 6A.

Figure 3:
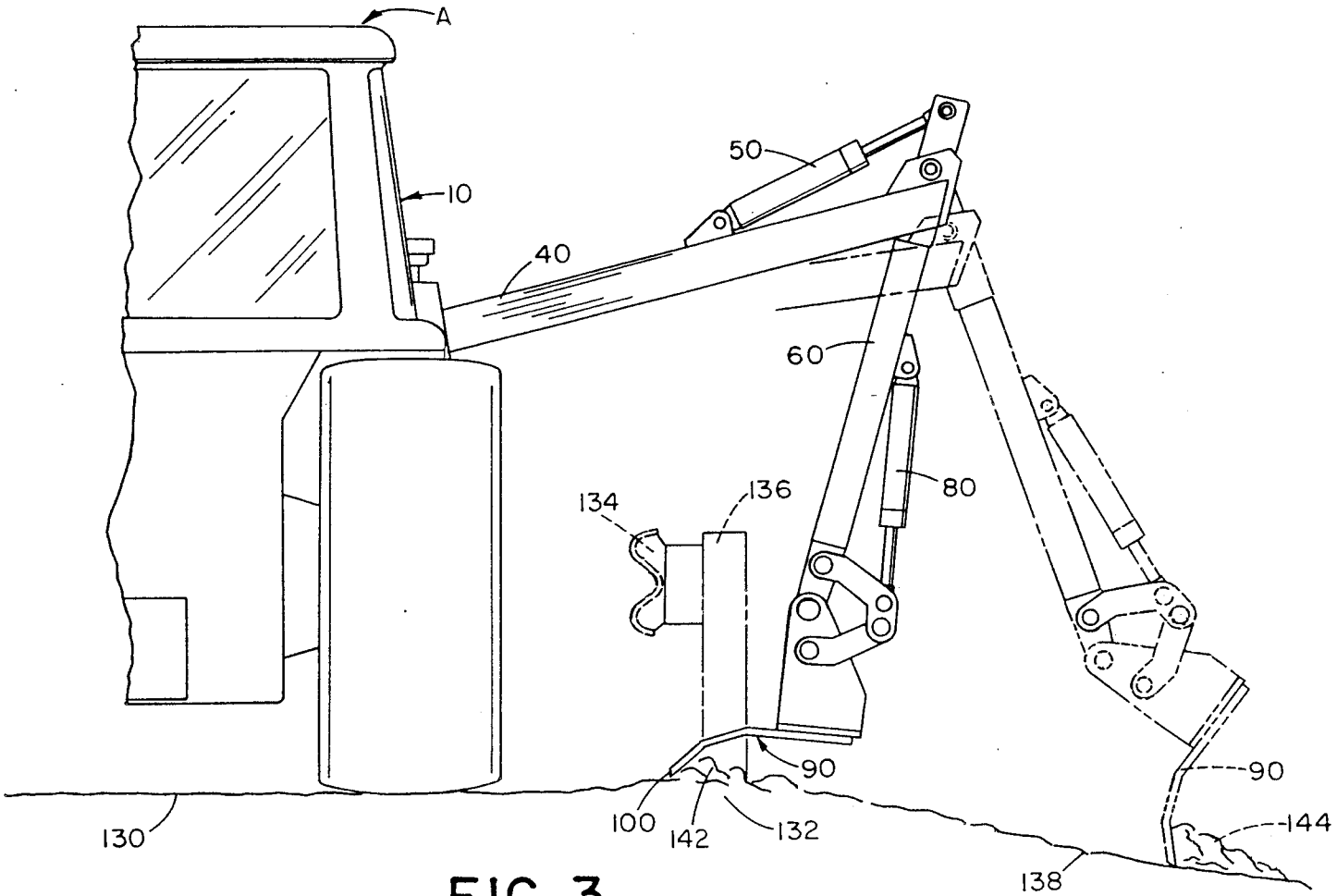
FIG. 3 is a side elevational view partially broken away illustrating the use of the sloper apparatus in cleaning debris from a berm of a road.

With reference also to FIG. 3, the use of the sloper assembly of the present invention will be illustrated. A road surface 130 has adjacent a shoulder or berm 132 thereof, a guardrail 134 that is secured by suitable spaced rail posts 136 to the ground surface. Extending downwardly away from the road surface 130 is a slope 138 of the shoulder. As debris 142, such as dirt, stones, scrub grass, trash or other material piles up adjacent and underneath the guardrail 134, it will become necessary to clean the debris away and reslope the berm so that water can successfully flow away from the road surface when it rains in order that the road not become washed out by heavy rains. For this purpose, the vehicle A is positioned adjacent the guardrail 134 such that the arm assembly B is so positioned that the outer arm 60 is located on the back side of the guardrail with the blade 90 being elevated from the ground surface and its edge wear bit 100 facing the tractor 10. The blade is then lowered to the ground surface in such a way that its edge wear bit 100 is preferably located directly beneath the guardrail 134.

Thereupon, the respective hydraulic cylinders, i.e., the hoist cylinder (not visible), the crowd and retract cylinder 50 and blade cylinder 80 are so actuated as to move the blade 90 away from the vehicle A while keeping the edge wear bit 100 thereof in contact with the slope 138 of the shoulder. In this way, the debris 142 will be pushed backwards away from the guardrail while simultaneously sloping the ground surface. The debris will therefore be pushed away as at 144 by the blade 90. While a substantial amount of debris can be pushed away with one stroke of the blade, more than one stroke may be necessary in some circumstances.

Figure 4:
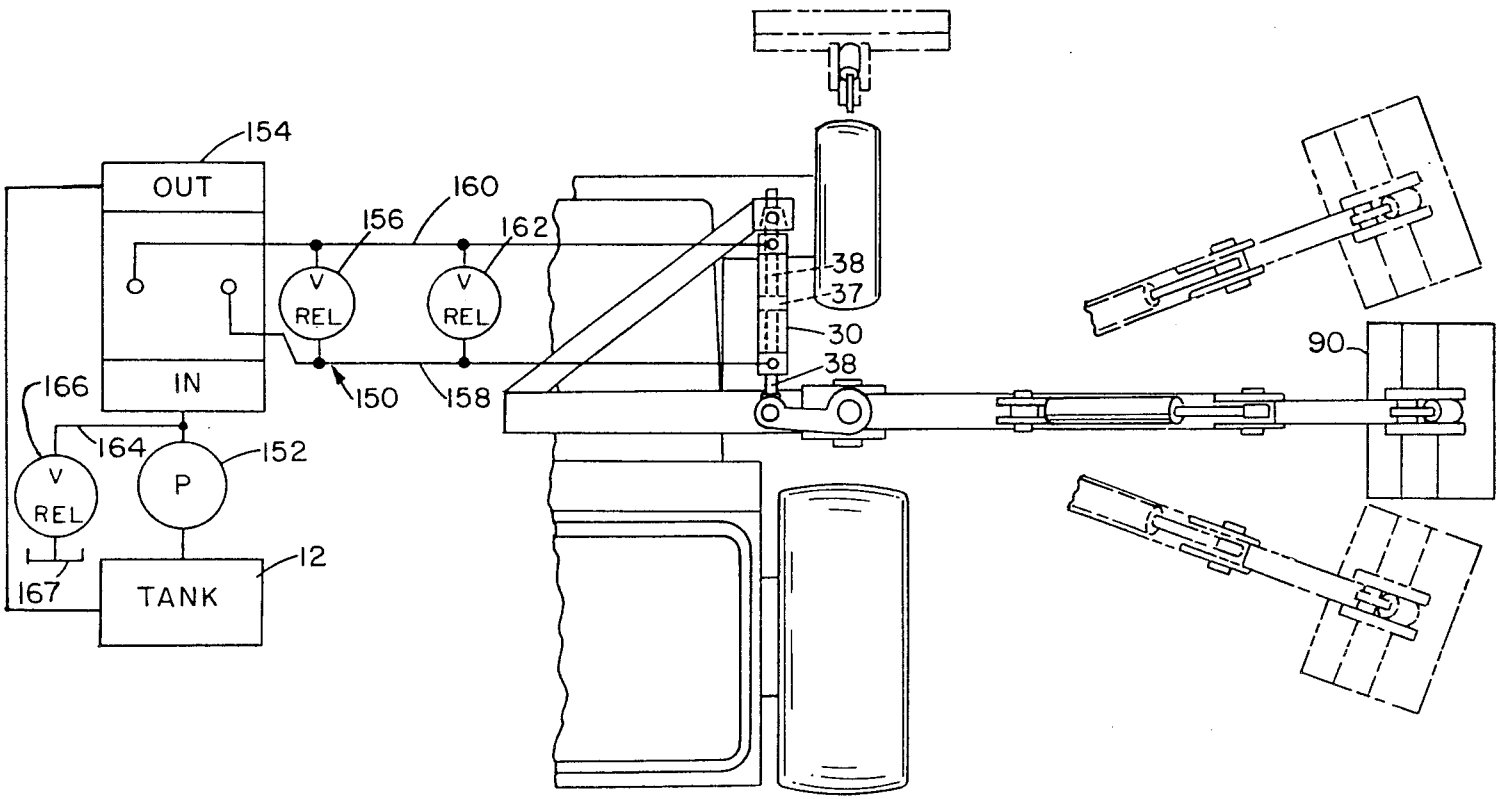
FIG. 4 is a partially broken away schematic top plan view of the sloper apparatus of FIG. 1 together with a hydraulic breakaway system for the apparatus.

With reference now also to FIG. 4, provided on the vehicle A is a breakaway system 150 for the swing cylinder 30. The breakaway system is located in a hydraulic circuit which a pump 152 that draws hydraulic fluid from the tank 12 and sends it through a control valve 154 to the respective ends of the swing cylinder 30 as necessary. The breakaway system 150 preferably includes a first one way relief valve 156 that is connected between an inlet line 158 and an outlet line 160 of the cylinder 30. The relief valve 156 permits the arm assembly, and its sloper assembly, to swing rearward in response to a preselected first or rearward breakaway pressure or force. Preferably, the system 150 includes another one way pressure relief valve 162 which allows the arm assembly and sloping apparatus to swing forward in response to a preselected second or forward breakaway pressure or force. The force to cause the arm assembly and sloping apparatus to swing or breakaway to the forward and to the rearward directions, as illustrated in dotted lines, may be the same or different. Such a breakaway assembly will prevent damage to either the arm assembly or the sloping assembly when the sloping assembly blade 90 impacts relatively immovable objects such as stumps, fence posts, large rocks or the like.

Preferably, also provided in the hydraulic system is a line 164 which leads to a relief valve 166. The relief valve vents excess hydraulic fluid to a sump 167. The sump may be the tank 12 if desired.

While the breakaway system is shown as having both a forward breakaway feature and a rearward breakaway feature, it should be recognized that a breakaway feature in a single direction could be provided if only such was needed. In other words, a single one way pressure relief valve could be provided instead of the two shown in FIG. 4, if that were considered desirable.

In use, the boom arm assembly is normally positioned at right angles to the axis of the tractor 10, as illustrated in FIG. 4. However, it should be recognized that the blade can be positioned in other orientations to the axis of the tractor as may be required in certain situations.

During normal travel of the tractor 10, the boom arm assembly is pivoted 90° from its normal work position such that the blade 90 is positioned over a front right wheel of the tractor as illustrated in dotted lines.

Figure 5B:
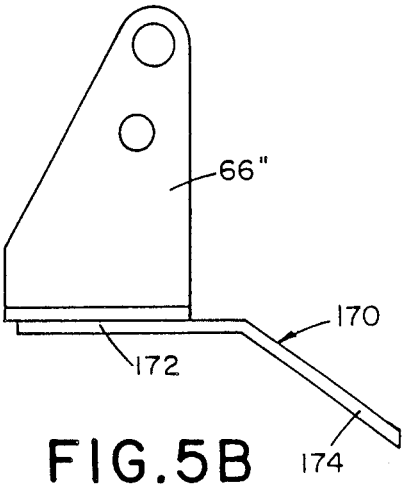
FIG. 5B is a side elevational view of a trunion and sloping blade according to a first alternate embodiment of the present invention.

With reference now also to FIG. 5B, a second type of blade is there illustrated. For ease of understanding of this alternative, like components are identified by like numerals with a double primed suffix (″) and new components are identified by new numerals.

In this FIGURE, attached to a trunion 66″ is a blade 170 which is comprised of two planar sections that are angled with respect to each other, namely, a first section 172 and a second section 174. The two sections can be suitably secured to each other such as by welding or they can be manufactured from a single planar piece of metal that is suitably bent. A suitable edge wear bit can be secured at the free edge of the second section as in the embodiment of FIG. 5A.

Figure 5C:
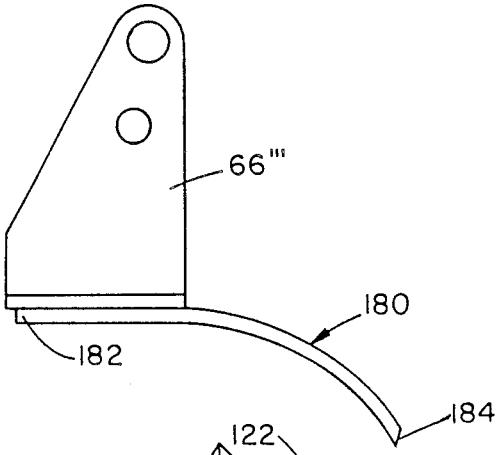
FIG. 5C is a side elevational view of a trunion and sloping blade according to a second alternate embodiment of the present invention.

With reference now to FIG. 5C, a yet third type of blade is there illustrated. For ease of understanding of this alternative, like components will be identified by like numerals with a triple primed suffix (‴) and new components will be identified by new numerals.

In this embodiment, a curved blade 180 is secured to a trunion 66‴. The blade 180 is so curved that a first end 182 thereof is located at an obtuse angle in relation to a second end 184 of the blade. A suitable edge wear bit can be secured at the blade second end 184.

With reference now again to FIG. 2, it should be recognized that the arm or boom assembly B of the present invention can be utilized not only for sloping purposes but also to support a movable cutter head for the trimming of vegetation on the berm of a road, or a ditching device. However, in this use environment, the outer arm 60 needs to be rotated 180° around its longitudinal axis in order that the cutter blade or ditching device cylinder be correctly positioned. For this purpose, the top end of the outer arm can be substantially straight such that the pin 56 securing the piston rod of the crowd and retract cylinder is positioned in the middle of the arm 60. In this way, when the pins 56 and 62 are removed, the outer arm can be disengaged from the inner arm. Thereupon, once the linkage assembly 70 and the rest of the sloper assembly C are removed from the outer arm, a suitable mower assembly can be attached thereto and the outer arm can subsequently be resecured in place on the inner arm with the cylinder 80 facing the tractor instead of facing away from the tractor.

As an alternative, however, and with reference now to FIG. 2B, an outer arm 190 can have an upper end 192 that is substantially angled in relation to the rest of the arm. In use, the angled portion would point towards the tractor. In this arm construction, a pair of ears 194, 196 are provided on opposing sides of the arm 190. In this way, a blade cylinder 198 can be detached from an inner ear 196 of the outer arm 190 and subsequently the entire sloper assembly can be similarly detached. Thereafter, a suitable mower assembly and mower cylinder can be secured to the outer ear 194 of the arm. In this way the apparatus has been reconfigured as a mower without having to rotate the outer arm 190, since the outer arm in this case can not be so rotated.

While one type of hydraulic breakaway circuit was illustrated in FIG. 4, it should be appreciated that other types of such breakaway circuits could also be utilized. In this connection, and with reference now to FIG. 7, another type of hydraulic circuit is there disclosed. In this embodiment, the circuit includes a hydraulic pump 202 which can be conventionally powered by, e.g., the power take off of a tractor (not illustrated) in order to pressurize fluid from a hydraulic fluid tank 204 and direct it through a valve 206. The valve can, if desired, be a three-envelope four-way valve which is spring biased to a center "off" position and is selectively actuated to either end position by a suitable solenoid. In the center position, fluid flow is blocked from fluid lines 208 and 210 leading to either end of a cylinder 212. As is illustrated, fluid flow is blocked to the cylinder 212, thereby locking the cylinder.

Unlike the double-acting cylinder with a double end rod which was illustrated in FIG. 4, in this construction the cylinder 212 includes a piston element 214 as well as a piston rod 216 which extends out one end of the cylinder. This is conventionally termed a double-acting cylinder with a single end rod. Assuming that the cylinder is locked in the position illustrated and further assuming that the scraper assembly strikes a stationary object from such a direction that the piston 214 will be forced to the left, then pressurized hydraulic fluid will flow out of the ram cylinder through a relief valve 218 in an exhaust line 220 and into a second exhaust line 222 and thence into a tank exhaust line 224. The fluid will then flow back to the right side of the ram piston 2I4 by way of a return line 226 a check valve 228 and the line 210. However, since the left side of the cylinder contains somewhat more fluid than the right side since there is a piston rod 216 extending through the right side but not through the left side, not all the fluid exhausted from the left side will be required to be added to the right side. Accordingly, a certain amount of the fluid will flow into the tank 204 through the line 224.

A force exerted on the scraper assembly in the opposite direction such that the piston will be forced to the right causes pressurized hydraulic fluid to flow out of the ram cylinder through a second relief valve 232 positioned in the exhaust line 222 into the tank line 224 and then into the return line 226. This fluid will then flow into an auxiliary return line 234 and then through a check valve 236 and into the line 208. It should be appreciated that an inadequate amount of fluid will flow into the left side of the ram piston 214 since the volume of hydraulic fluid stored in the left side of the cylinder 212 is greater than the volume of fluid stored on the right side because the left side does not have a piston rod as does the right side. Accordingly, some make up fluid will flow from the tank 204 through line 224, line 226, line 234 past check valve 236 and into the cylinder 212 through line 208 in order to make up the shortage of hydraulic fluid on the left hand end of the cylinder.

This same sequence of flow occurs when the valve 206 is positioned to pressurize either line 208 or 210 and an obstacle is encountered.

Figure 8:
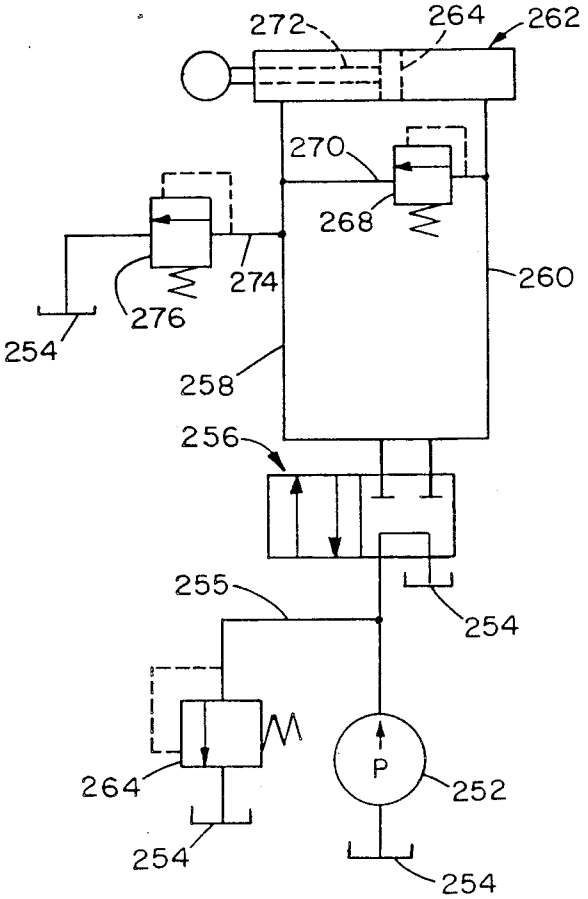
FIG. 8 is yet another alternate embodiment of a hydraulic breakaway system.

With reference now to FIG. 8, a different type of breakaway system is there illustrated. This breakaway system is unidirectional and can be applied in a situation where, for example, only a rearward breakaway is desired. The assembly includes a pump 252 which pressurizes hydraulic fluid withdrawn from a tank 254 and sends it to a valve 256. What is illustrated is a normally closed two position four-way valve. While the valve in this case is not illustrated to be normally biased to the closed position and solenoid actuated open, it could be that type of valve. Alternatively, the valve could be manually actuated. It should also be recognized that the valve 206 illustrated in FIG. 7 could be similarly manually actuated if that were desired. The valve 256 controls the flow of hydraulic fluid into a line 258 and out of a line 260. These lines are connected to respective ends of a hydraulic cylinder 262 which receives pressurized fluid from line 258 under the control of the valve 256. With the valve in a closed position, so that fluid flow through line 258 from the pump 252 is blocked, fluid will flow into a sump which is preferably the sump 254 or through a relief valve 264 in the fluid line 255 to the sump 254.

Assuming that the cylinder is locked in position, and further assuming that the scraper assembly strikes a stationary object from such a direction that a cylinder piston 264 will be forced to the right, pressurized fluid will be forced to flow out of the ram cylinder and into line 260. Since such flow is cut off at the valve 256, the pressurized fluid will then flow through a pressure relief valve 268 positioned in a line 270 that connects the two lines 258 and 260. Upon flowing into the line 270 past the pressure relief valve, the pressurized fluid then flows into line 258 and back to the other side of the cylinder. It should be recognized that the cylinder 262 is also a double acting cylinder with a single end rod 272. Therefore, not all of the fluid which flows out through line 260 will be necessary to fill the volume on the other side of the piston 264 since some of the volume is filled by the piston rod 272. Accordingly, provided in fluid communication with line 258 is an exhaust line 274 in which is positioned a pressure relief valve 276 which allows excess fluid to flow back into the sump 254.

The invention has been described with reference to preferred and alternate embodiments. Obviously, modifications and alterations will occur to others upon the reading and understanding of the preceding specification. It is intended that the invention be construed as including all such alterations and modifications insofar as they come within the scope of the appended claims or the equivalents thereof.

What is claimed is:

1. A sloper apparatus comprising a tractor and a sloper assembly adapted to push earth and debris away from a berm of a road, comprising:

A. a tractor having a hydraulically powered take-off and a reservoir therefor;

B. a support stand pivotally connected to said tractor for rotation about a vertical axis;

C. a first outrigger arm pivotally connected to the support stand and extending outwardly therefrom;

D. a first hydraulic cylinder pivotally connected between the support stand and said first outrigger arm;

E. a sloper assembly;

F. a second outrigger arm pivotally connected to the first outrigger arm and supporting the sloper assembly, wherein said sloper assembly comprises a planar sloping blade which extends substantially normal to said second outrigger arm and comprises a blade first end, at which said blade is operably secured to said second outrigger arm and, spaced therefrom, a blade second end, which is adapted to contact a ground surface, said blade second end being oriented at an obtuse angle in relation to said blade first end;

G. a second hydraulic cylinder extending generally parallel to said first outrigger arm and attached thereto and being operatively connected with the second outrigger arm;

H. a third hydraulic cylinder operatively connected between the second outrigger arm and said sloper assembly; and, I. a fourth hydraulic cylinder operatively connected between the tractor and the support stand, the fourth hydraulic cylinder having overload protection such that the entire support stand, first and second outrigger arms and the sloper assembly will pivot horizontally about said vertical axis in the event the sloper assembly meets an obstruction in order to avoid damaging the tractor and the sloper assembly.

2. The apparatus of claim 1 wherein said sloper assembly further comprises a trunion operatively connected at one end to said second outrigger arm;

and wherein said sloping blade is secured to another end of said trunion.

3. The apparatus of claim 2 further comprising an edge wear bit secured to said sloping blade in a selectively removable manner.

4. The apparatus of claim 3 further comprising at least one bolt for securing said edge wear bit to said blade.

5. The apparatus of claim 3 wherein a cutting edge of said edge bit is beveled at approximately 45°–60°.

6. The apparatus of claim 2 wherein said sloping blade comprises at least two sections which are planar, are spaced along said blade, and which are angled with respect to each other.

7. The apparatus of claim 2 wherein said sloping blade comprises a curved plate having a second end which is located at an obtuse angle in relation to a blade first end.

8. The apparatus of claim 2 wherein said sloping assembly further includes a linkage assembly pivotally secured to said trunion and said second outrigger arm, and wherein said second arm includes:

a first ear section to which one end of said third hydraulic cylinder is pivotally secured, another end of said third hydraulic cylinder being pivotally secured to said linkage assembly; and, a second ear section located on an opposite side of said second arm from said first ear section, whereby said third piston and linkage assembly can be reversed in relation to said second arm by disconnecting said third piston one end from said first ear section, while also disconnecting said linkage assembly and said trunion from said second arm, rotating said third piston and said linkage assembly 180° in relation to a longitudinal axis of said second arm and reconnecting said linkage assembly to said second arm and said third piston one end to said second ear.

9. The apparatus of claim 1 wherein said overload protection of said fourth hydraulic cylinder includes a first one-way pressure relief valve which permits hydraulic fluid to flow from a first chamber of said fourth cylinder to a second chamber thereof when a hydraulic fluid pressure in said first chamber exceeds the pressure in said second chamber by a preselected amount.

10. The apparatus of claim 9 wherein said overload protection of said fourth hydraulic cylinder includes a second one-way pressure relief valve which permits hydraulic fluid to flow from said second chamber of said fourth cylinder to said first chamber thereof when a hydraulic fluid pressure in said second chamber exceeds the pressure in said first chamber by a preselected amount.

11. The apparatus of claim 1 wherein said overload protection of said fourth hydraulic cylinder comprises a valve means for permitting displacement of pressure fluid from one side of the piston to the other side of the piston and for simultaneously passing hydraulic fluid into and out of said reservoir as necessary to compensate for any excess of hydraulic fluid and insufficiency of hydraulic fluid resulting from a movement of said piston in said fourth cylinder.

12. The apparatus of claim 1 wherein said forth hydraulic cylinder is a double acting cylinder, and said overload protection for said fourth hydraulic cylinder comprises a control valve and hydraulic circuit for operating said cylinder in one direction and hydraulically locking said fourth cylinder in desired positions by blocking hydraulic flow to and from said piston, said circuit including first and second hydraulic pressure lines connecting said valve to opposing ends of said fourth cylinder and said reservoir, a first pressure relief valve connected between said first and second hydraulic lines to permit operation of said fourth cylinder in one direction when locked as necessitated by a movement of said piston in said fourth cylinder and a second pressure relief valve communicating with one of said first and second hydraulic pressure lines for venting excess hydraulic fluid to said reservoir.

13. The apparatus of claim 1 wherein said third hydraulic cylinder faces away from said tractor, and said second outrigger arm is substantially straight and has a longitudinal axis about which it can be rotated so that said second arm can be detached at its pivot connection to said first outrigger arm and rotated 180° about its longitudinal axis and then reattached to said first outrigger arm to allow said third hydraulic cylinder to be positioned in direction facing said tractor.

14. A mobile sloping apparatus comprising:

a prime mover;

an arm assembly having first and second ends, a first end being operatively connected to the prime mover such that said arm assembly can undergo rotational movement about a vertical axis in relation to said prime mover;

a sloper assembly secured to said second end of said arm assembly such that said sloper assembly can undergo rotational movement about an axis parallel to a longitudinal axis of said prime mover as well as longitudinal movement along an axis lying at an angle to said prime mover longitudinal axis, said sloper assembly comprising:

a trunion pivotally mounted to said arm assembly second end, and a planar sloper blade extending substantially parallel in relation to a bottom face of said trunion, said sloper blade having a first end at which it is secured to said trunion and a second end adapted to contact a ground surface, said blade second end being located closer to said prime mover than said blade first end, said sloper blade being substantially angled such that said blade second end is located at an obtuse angle in relation to said blade first end.

15. The apparatus of claim 14 further comprising: a hydraulic breakaway circuit including:

(i) a first through-rod-type hydraulic cylinder operatively connected with the arm assembly for controlling a rotational position of the arm assembly relative to the prime mover, the first cylinder including a cylinder housing, a piston slidably received within the cylinder housing dividing it into first and second chambers such that increasing the pressure in one chamber relative to the pressure in the other chamber causes the piston to move, and a through-rod extending from one end of the housing, through and fixedly attached to the piston, and through the other end of the housing, the rod having the same outer diameter in both the first and second chambers and the housing having the same inner diameter in both the first and second chambers such tat the amount of fluid displaced from one of the chambers as the piston moves is the same as the amount of fluid required to maintain the other chamber filled;

(ii) a hydraulic fluid control valve for controlling the relative pressure in the first and second chambers of the first hydraulic cylinder, the first hydraulic control valve having a first port in fluid connection with the first chamber and a second port in fluid communication with the second chamber;

(iii) a first one-way, relief valve operatively connected between the first and second chambers for allowing fluid to flow from the first chamber to the second chamber when the pressure in the first chamber exceeds the pressure in the second chamber by a first preselected pressure, the first pressure relief valve prohibiting the flow of hydraulic fluid from the second chamber to the first chamber therethrough, whereby in response to the grading assembly contacting a relatively immovable object which tends to cause the arm assembly to rotate in a first direction until the pressure differential exceeds the first preselected pressure and the first pressure relief valve permits fluid to flow between the hydraulic cylinder chamber allowing the arm assembly to rotate;

(iv) a fluid reservoir; and (v) a hydraulic fluid pump for pumping hydraulic fluid from the hydraulic fluid reservoir to the first hydraulic view.

16. The apparatus of claim 15 further comprising:

a second one-way, pressure relief valve connected in parallel with the first one-way relief valve, the second relief valve permitting fluid to flow from the second chamber to the first chamber when the pressure in the second chamber exceeds the pressure in the first chamber by a second preselected pressure such that in response to the cutting apparatus contact an object with sufficient force, the second one-way pressure relief valve permits the arm assembly to break away and yield in a second direction.

17. The apparatus of claim 14 further comprising an edge wear bit secured to said sloping blade in a selectively removable manner, said edge wear bit extending substantially normal in relation to said trunion bottom face.

18. The apparatus of claim 17 wherein a cutting edge of said edge wear bit is beveled at approximately 45° to 60°.

19. The apparatus of claim 14 wherein said sloper blade comprises a curved plate.

20. The apparatus of claim 14 wherein said sloper blade comprises at least two planar sections which are angled with respect to each other.

21. A boom grading apparatus comprising:

a prime mover;

a sloping blade adapted for scraping a ground surface, wherein said sloping blade is substantially angled such that a first end of said blade is located at an obtuse angle in relation to a blade second end;

a trunion to which one end of said sloping blade is secured;

a boom assembly including a first boom arm movably interconnected to said prime mover and a second boom arm pivotally interconnected at a first end with said first arm and, at a second end, with said trunion;

a hydraulic actuator mounted on said second boom arm, and having longitudinally separated extensible and contractible positions, said hydraulic actuator being operatively connected at a first end with said second boom arm; and a linkage assembly pivotally secured to said trunion and said second boom arm, said linkage assembly comprising:

a first link having a first end pivotally coupled to said second boom arm, an elbow region pivotally coupled to a second end of said hydraulic actuator, and a second end, and a second link having a first end pivotally coupled to said trunion, and a second end pivotally connected to said first link second end, said linkage assembly converting a longitudinal motion of said hydraulic actuator into rotational motion of said trunion about said second boom arm.

22. The apparatus of claim 21 further comprising an elongated edge wear bit which is secured to one edge of said sloping blade in a selectively removable manner.

23. The apparatus of claim 22 further comprising at least one bolt for securing said edge wear bit to said blade.

24. A mobile sloping apparatus comprising:

a prime mover;

an arm assembly operatively connected at a first end to said prime mover; and, a planar sloper blade operatively connected, at a first end, to a second end of said arm assembly, wherein said sloper blade extends in a plane generally normal to a longitudinal axis of said arm assembly and wherein said sloper blade includes a second end, which is adapted to contact an associated ground surface, wherein said sloper blade second end is located at an obtuse angle in relation to said sloper blade first end.

25. The apparatus of claim 24 further comprising an elongated edge wear bit secured to said sloper blade second end.

26. The apparatus of claim 24 wherein said sloper blade comprises at least two planar sections which are spaced along said blade and are angled in relation to each other.

27. The apparatus of claim 24 further comprising a trunion which is secured to said second end of said arm assembly, wherein said sloper blade first end is secured to said trunion, and wherein said sloper blade extends in a plane generally parallel to a lower surface of said trunion.

* * * * *